United States Patent [19]

Kleimenhagen et al.

[11] 4,026,260

[45] May 31, 1977

[54] SPEED SENSITIVE FUEL CONTROL SYSTEM

[75] Inventors: Karl L. Kleimenhagen; Mark F. Sommars, both of Peoria, Ill.

[73] Assignee: Caterpillar Tractor Co., Peoria, Ill.

[22] Filed: Aug. 4, 1975

[21] Appl. No.: 601,762

[52] U.S. Cl. ..... 123/140 R; 123/140 MC

[51] Int. Cl.[2] ..... F02D 1/04

[58] Field of Search ..... 123/140 R, 140 MC

[56] References Cited

UNITED STATES PATENTS

| | | | |
|---|---|---|---|
| 3,777,730 | 12/1973 | Gates | 123/140 R |
| 3,791,361 | 2/1974 | Hotmann | 123/140 R X |
| 3,911,885 | 10/1975 | Hammond | 123/140 R |
| 3,916,862 | 11/1975 | Glouse | 123/140 R X |

*Primary Examiner*—Harold W. Weakley

*Attorney, Agent, or Firm*—John W. Grant

[57] ABSTRACT

A fuel control member of an internal combustion engine is operative to control the flow of fuel to the engine and is operatively connected to an element of a speed responsive governor which is adapted to urge the fuel control member towad an increased fuel position when the load on the engine is increased. A device is provided for limiting movement of the fuel control member toward the increased fuel direction establishing a maximum fuel flow position of the fuel control member. A speed sensitive flyweight arrangement is connected to the element of the governor for moving it and the fuel control member in a decreased fuel flow direction for reducing the amount of fuel delivered to the engine when the engine speed decreases below a predetermined speed due to a load thereon.

8 Claims, 5 Drawing Figures

SPEED SENSITIVE FUEL CONTROL SYSTEM

BACKGROUND OF THE INVENTION

This invention relates to a fuel control system for controlling the fuel flow of a compression ignition engine and more particularly to a speed sensitive device for decreasing fuel flow to the engine under certain engine loading conditions.

Compression ignition engines commonly utilize a governor to position a fuel pump control member to maintain the engine speed within a predetermined operating range. When the load on the engine decreases, engine speed increases and the governor automatically retracts the fuel pump control member to reduce the supply of fuel to the engine. When the load on the engine is increased, the engine speed tends to decrease and the fuel pump control member is advanced to supply more fuel to the combustion chambers of the engine. A fixed full load stop is normally provided to limit the travel of the fuel pump control member and thus the maximum volume of fuel directed to the engine for establishing the full load speed of the engine. When the engine is lugged down below a certain speed due to increased loading applied to the engine, more fuel is directed to the combustion chambers than can be burned resulting in inefficient and incomplete burning of the fuel. This causes an increase in the noxious exhaust emission and smoke from the engine.

Other approaches to solving the above problem are taught by the constructions disclosed in U.S. patent application Ser. No. 409,864 filed Oct. 26, 1973 now U.S. Pat. No. 3,916,862 by Clouse et al. and in U.S. patent application Ser. No. 519,578 filed Oct. 31, 1974 now U.S. Pat. No. 391,885 by Hammond, both of which are assigned to the assignee of the present application.

OBJECTS OF THE INVENTION

Accordingly, an object of this invention is to provide an improved speed sensitive fuel control system which minimizes the amount of noxious exhaust emissions and smoke from the engine during certain lugging conditions.

Another object of this invention is to provide such an improved system which provides for normal governor control of the fuel delivery to the engine during normal operating conditions.

Other objects and advantages of the present invention will become more readily apparent upon reference to the accompanying drawings and following description.

DESCRIPTION OF THE PREFERRED EMBODIMENT

Figure 1:
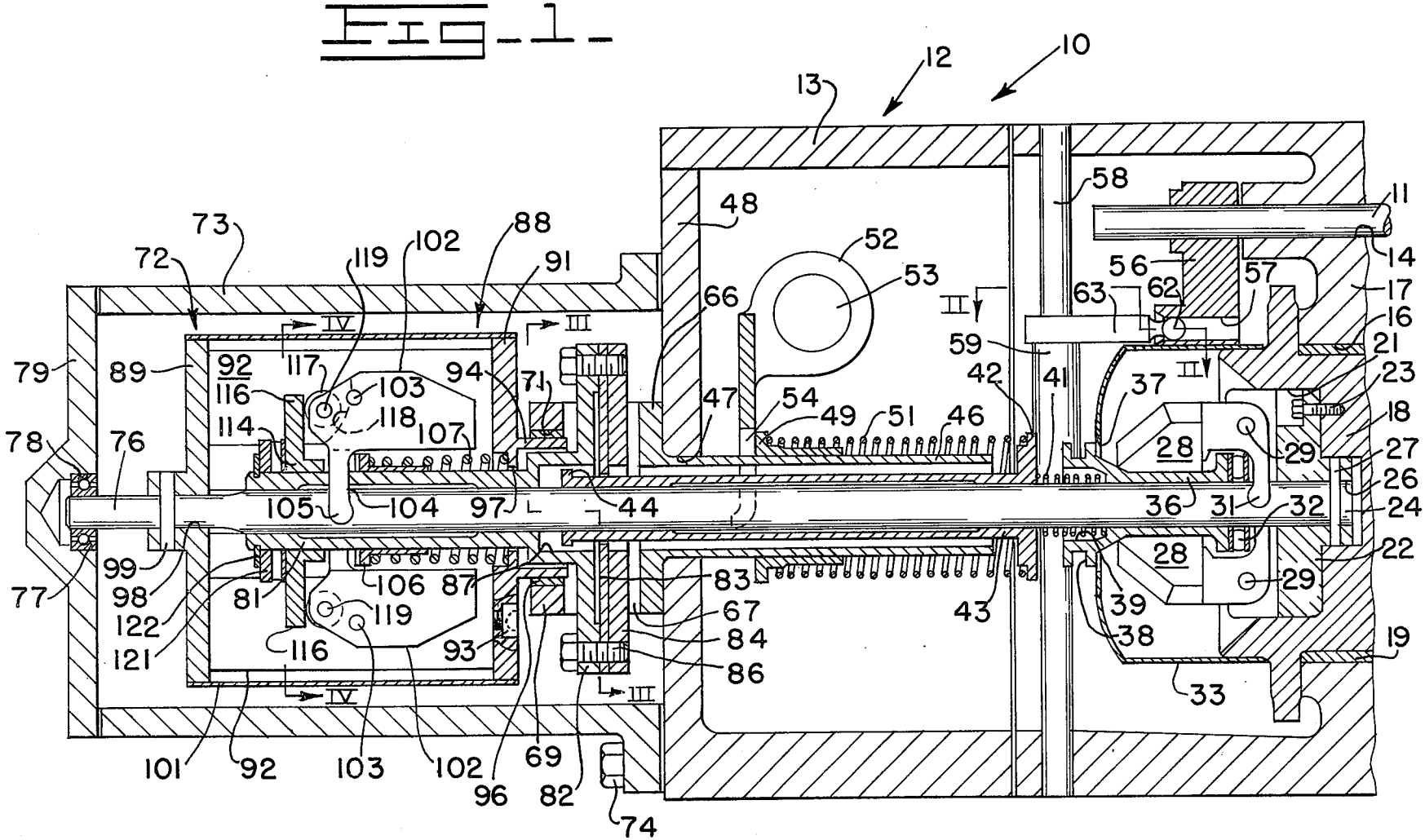
FIG. 1 is a longitudinal vertical sectional view through a speed sensitive fuel control system embodying the principles of the present invention.

Referring more particularly to the drawings, a speed sensitive fuel control system embodying the principles of the present invention is generally indicated by the reference numeral 10 for controlling the rotational position of a fuel control member partially shown at 11. The fuel control member is part of a sleeve metering pump, not shown, and rotation of the fuel control member in a first direction increases fuel flow to the engine while rotation of the fuel control member in the opposite direction decreases fuel flow to the engine.

The speed sensitive fuel control system 10 includes a primary flyweight arrangement in the form of a governor 12 which is contained withiin a housing 13 having a pair of bores 14 and 16 extending through an end wall 17. The fuel control member 11 extends through the bore 14 while a cam shaft, partially shown at 18, of the fuel pump rotationally extends through a bearing 19 disposed within the bore 16 and has a stepped bore 21 formed therein. A flyweight carrier 22 is disposed within the stepped bore of the cam shaft and is secured thereto by a plurality of bolts, one shown at 23. An elongated drive shaft 24 extends into a bore 26 formed in the flyweight carrier and is secured thereto by a pin 27. A plurality of flyweights 28 are pivotally attached to the carrier by pins 29 with each flyweight having an inwardly extending arm 31 adapted to contact a thrust bearing 32 slidably disposed on the drive shaft. A cover 33 is secured to the cam shaft and encloses the flyweights.

A thrust collar 36 is slidably disposed on the drive shaft 24 and has one end in abutting engagement with the thrust bearing 32. The opposite end of the collar extends through a bore 37 in the cover 33 and has an annular groove 38 formed on its periphery and an annular recess 39 formed therein in circumscribing relation to the drive shaft. An overfueling spring 41 is disposed within the recess and provides a resilient separating force between the thrust collar and a governor spring seat flange 42 of an elongated tubular member 43 which is slidably disposed on the drive shaft. A radially outwardly extending lip 44 is formed on the opposite end of the tubular member.

A tubular support 46 extends through a bore 47 in an end wall 48 of the housing 13 and into the housing in circumscribing relation to the tubular member 43. An annular governor spring seat 49 is slidably disposed on the tubular support. A governor spring 51 is disposed between the governor spring seat and the flange 42 for resiliently urging the tubular member 43 and the thrust collar 36 toward the flyweight carrier 22. A control lever 52 is attached to a control shaft 53 extending into the housing and has a bifurcated end 54 in engagement with the governor spring seat.

Figure 2:
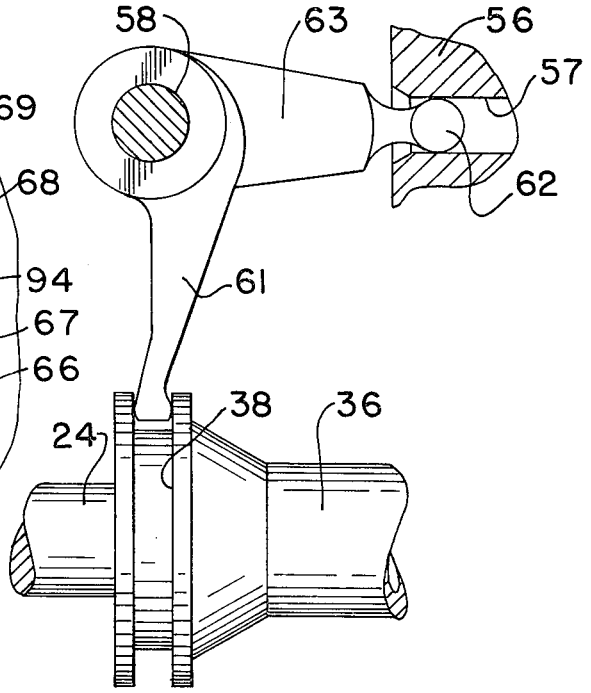
FIG. 2 is an enlarged fragmentary sectional view taken along line II—II of FIG. 1.
Figure 5:
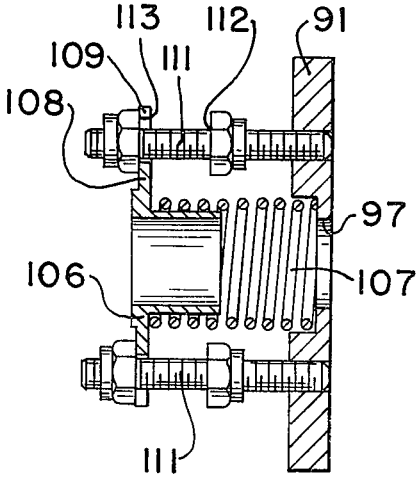
FIG. 5 is a sectional view taken along line V—V of FIG. 4.

A lever 56 is secured to the fuel control member 11 protruding into the housing 13 and has a bore 57 formed in its distal end parallel to the fuel control member. An elongated pivot shaft 58 extends through the housing perpendicular to the drive shaft 24 and pivotally supports a bell crank 59. As more clearly shown in FIG. 2, the distal end of a first lever arm 61 of the bell crank extends into the annular groove 38 of the thrust collar 36. A spherical portions 62 is formed on the distal end of a second lever arm 63 with the spherical portion being disposed within the bore of the lever 56.

Figure 3:
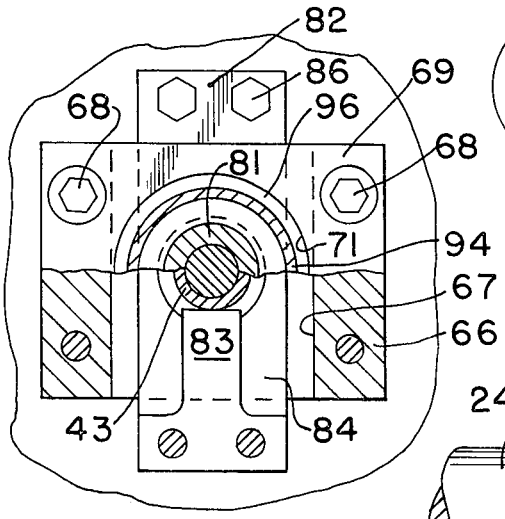
FIG. 3 is a sectional view taken along line III—III of FIG. 1.

As more clearly shown in FIG. 3, a rectangular flange 66 is formed on the end of the tubular support 46 and has a vertically oriented slot 67 provided therein. The flange abuts the end wall 48 and is secured thereto by a plurality of bolts 68 which also secure a plate 69 to the flange. The plate has a bore 71 extending therethrough.

A secondary speed sensitive flyweight arrangement 72 is contained within a housing 73 secured to the end wall 48 of the housing 13 by a plurality of bolts, one of which is shown at 74. An end 76 of the drive shaft 24 is rotatably supported in a bearing 77 disposed within a bore 78 formed in an end wall 79 of the housing. The flyweight arrangement includes a tubular spring carrier 81 slidably disposed on the drive shaft and has a pair of diametrically opposed outwardly extending ears 82 formed on one end thereof with the ears being disposed within the slot 67 in the flange 66. A pair of radially inwardly extending fingers 83 are sandwiched between the ears and a rectangular backup plate 84 secured to the ears by a plurality of bolts 86. The inner ends of the fingers are adapted for engagement with the lip 44 of the tubular member 43. Alternately, the fingers may be replaced with a torque spring to resiliently restrain movement of the tubular member toward the cam shaft. An annular recess 87 is formed in the spring carrier to loosely receive the lip of the tubular member.

A flyweight carrier 88 includes a pair of axially spaced circular end plates 89 and 91 secured to the opposite end of two pair of parallel spaced elongated plates 92 by a plurality of bolts, one shown at 93. The end plate 91 is disposed adjacent to the plate 69 and has an annular projection 94 which extends axially into and is rotatably supported by a bearing 96 disposed within the bore 71 of the plate 69. The end plate also has a central aperture 97 through which the spring carrier 81 extends. The drive shaft extends through a bore 98 in the end plate 89 and is secured thereto by a pin 99 for driving the flyweight carrier. An annular cover 101 extends between and has its ends secured to the end plates.

Figure 4:
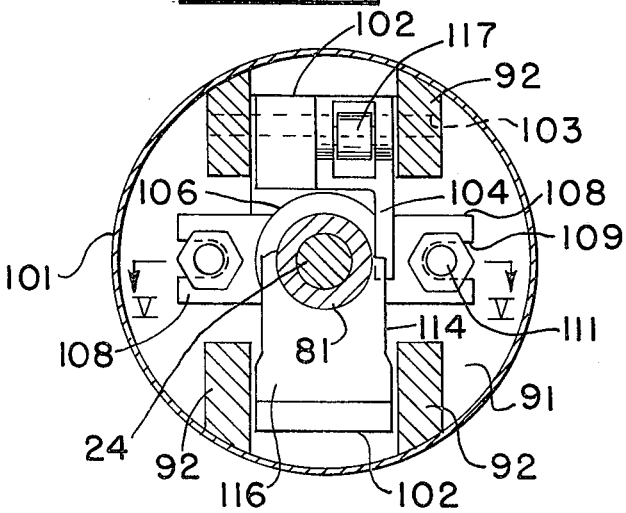
FIG. 4 is a sectional view taken along line IV—IV of FIG. 1.

Each of a pair of flyweights 102 is disposed between a respective pair of the plates 92 and is pivotally secured thereto by a pivot pin 103. Each flyweight has an arm 104 extending inwardly with a distal end 105 of the arms disposed on opposite sides of the spring carrier 81. The distal ends are in engagement with an annular spring seat collar 106 slidably disposed on the spring carrier. A spring 107 is disposed between the spring seat collar and the end plate 91. As more clearly shown in FIGS. 3 and 4 the spring seat collar has a pair of laterally extending ears 108 each of which has a notch 109 formed therein. A pair of stop members 111 are secured to the end plate 91 with each stop having a pair of stop surfaces 112 and 113 provided thereon. The notches on the ears straddle the stop members with the ears being disposed between the stop surfaces.

A thrust ring 114 is slidably disposed on the spring carrier 81 and has a pair of outwardly extending flanges 116 each of which is disposed between a respective pair of the plates 92 for engagement with a roller 117 rotatably secured within a slot 118 in each flyweight 102 by a pin 119. A thrust bearing 121 encircles the spring carrier and is disposed between the thrust ring and a snap ring 122.

OPERATION

While the operation of the present invention is believed clearly apparent from the foregoing description, further amplification will subsequently be made in the following brief summary of such operation. The amount of fuel delivered to the engine and thus the engine speed is controlled by the rotational position of the fuel control member 11. The rotational position of the fuel control member is in turn controlled by the position of the thrust collar 36 through the bell crank 59 and lever 56. Movement of the thrust collar to the right as viewed in FIG. 1, rotates the bell crank counterclockwise as viewed in FIG. 2, increases the fuel flow to the engine. Conversely, moving the thrust collar to the left rotates the bell crank clockwise causing a decrease in fuel flow to the engine. Thus, for purposes of describing the operation of the present invention, rightward movement of the thrust collar increases fuel flow to the engine while leftward movement of the thrust collar decreases fuel flow to the engine.

The position of the elements of the speed sensitive fuel control system as shown in FIG. 1 is indicative of an engine stopped condition. For starting the engine, the control shaft 53 is rotated counterclockwise causing the control lever 52 to move the governor spring seat 49 to the right causing the governor spring 51 resiliently to urge the tubular member 43 to the right. The rightward movement of the tubular member preloads the overfuel spring 41 to maintain the thrust collar 36 in an overfueling position for starting the engine.

After the engine starts the cam shaft 18 rotated by the engine and the flyweights 28 pivot outwardly with the arms 31 forcing the thrust collar 36 to the left. The initial leftward movement of the thrust collar compresses the overfueling spring and the thrust collar subsequently engages the flange 42 moving the tubiular member 43 to the left against the bias of the governor spring 51. The leftward movement of the thrust collar continues until the centrifugal force of the flyweights balances the axial force of the governor spring, thus establishing an instantaneous speed of the engine. For increasing the speed of the engine, the control shaft 53 is rotated counterclockwise to increase the axial force of the governor spring while clockwise rotation of the control shaft decreases the engine speed.

Also, upon starting of the engine, the drive shaft 24 rotates the flyweight carrier 88 of the secondary flyweight arrangement 72. This causes the flyweights 102 to pivot outwardly about the pivot pins 103 with the distal ends 105 of the arms 104 exerting an axial force against the spring seat collar 106 compressing the spring 107. At a predetermined engine speed, the ears 108 of the spring seat collar contact the stops 112 preventing further outwardly pivoting of the flyweights.

The governor 12 is responsive to engine speed and functions to maintain the engine speed within a predetermined operating range by adjusting the position of the thrust collar 36 as the load on the engine varies. The predetermined speed range is established by manual positioning of the control lever 52 to provide a preload force on the governor spring 51 to act against the centrifugal force of the flyweights 28 through the tubular member 43 and the thrust collar. When the load on the engine is increased, engine speed tends to decrease resulting in a corresponding reduction in the axial force of the flyweights thereby allowing the governor spring to move the thrust collar to the right for supplying more fuel to the engine to maintain the engine speed within the desired range.

As the tubular member 43 and thrust collar 36 are moved to the right under increasing engine loads, the lip 44 of the tubular member engages the fingers 83. This in turn moves the carrier 81 to the right until the thrust collar 114 engages the rollers 117 attached to the flyweights 102. At this point, rightward movement of the spring carrier, tubular member and thrust collar is stopped thereby limiting the amount of fuel delivered to the engine.

As the engine speed continues to drop under increased loading, the governor spring 51 maintains the tubular member 43 and thrust collar 36 in their rightward position described above. The centrifugal force of the flyweights 102 acting against the spring seat collar 106 through the arms 104 also decreases. When the decreasing engine speed drops below the predetermined speed, the force of the spring 107 acting against the arms 104 of the flyweights 102 in combination with the decrease in centrifugal force of the flyweights is effective to rotate the flyweights clockwise about their pivots pin 103. The pins 119 pivotally supporting the rollers 117 are disposed inwardly relative to the radial position of the pins 103 with the pins 119 being placed closer to the pins 103 than to the distal ends 105 of the arms 104. This provides a mechanical advantage so that the force exerted by the rollers against the thrust ring 114 is greater than the force exerted against the arms by the spring. Thus the rollers urge the thrust ring 114 to the left which in turn moves the ring carrier 81 to the left which in turn moves the tubular member 43 to the left overcoming the bias of the spring 51. As this occurs, the centrifugal force of the flyweights 28 is effective to move the collar 36 to the left in unison with the tubular member decreasing the amount of fuel delivered to the engine. The leftward movement of the spring carrier, tubular member, and thrust collar will continue until the bias of the governor spring counterbalances the effective force exerted by the spring 107 through the arms of the flyweights and the rollers.

In view of the foregoing, it is readily apparent that the structure of the present invention provides an improved speed sensitive fuel control system which minimizes the emission of noxious matter and smoke from an internal combustion engine by decreasing the volume of fuel injected into the engine when the engine speed decreases below a predetermined speed due to increased loading on the engine. Decreasing the volume of fuel injected into the engine permits more efficient and complete combustion of the fuel and is accomplished by the addition of a secondary flyweight arrangement which is operative to override the force of the governor spring so that the flyweights of the governor are effective to move the fuel control member to a reduced fuel setting.

While the invention has been described and shown with particular reference to the preferred embodiment, it will be apparent that variations might be possible that would fall within the scope of the present invention which is not intended to be limited except as defined in the following claims.

What is claimed is:

1. A speed sensitive fuel control system for an internal combustion engine, comprising;

a fuel control member for controlling the flow of fuel to the engine;

a speed responsive governor having an element operatively connected to the fuel control member and being of a construction sufficient for urging the fuel control member in a direction for increased fuel flow when the load on the engine is increased;

means for limiting movement of the fuel control member toward the increased fuel flow direction establishing a maximum fuel flow position of the fuel control member; and a separate flyweight assembly connected to said element of the governor and being of a construction sufficient for moving the element and the fuel control member in an opposite direction away from said maximum fuel flow position for decreasing fuel flow to the engine in response to the engine speed decreasing below a predetermined speed in response to a load thereon.

2. The speed sensitive fuel control system of claim 1 including a drive shaft and wherein said element of the governor is an elongated tubular member slidably disposed on said drive shaft and having opposite ends with one of said ends operatively connected to the fuel control member, said governor including a governor spring in engagement with the tubular member for resiliently urging the tubular member and fuel control member toward the increased fuel flow direction, and a control lever for applying a preload to the governor spring.

3. A speed sensitive fuel control system for an internal combustion engine, comprising;

a fuel control member for controlling the flow of fuel to the engine;

a speed responsive governor having an element operatively connected to the fuel control member for urging the fuel control member in a direction for increased fuel flow when the load on the engine is increased;

means for limiting movement of the fuel control member toward the increased fuel flow direction establishing a maximum fuel flow position of the fuel control member;

a flyweight arrangement connected to said element of the governor for moving the element and the fuel control member in a direction away from said maximum fuel flow position for decreasing fuel flow to the engine when the engine speed decreases below a predetermined speed due to a load thereon;

a drive shaft and wherein said element of the governor is an elongated tubular member slidably disposed on said drive shaft and having opposite ends with one of said ends operatively connected to the fuel control member, said governor including a governor spring in engagement with the tubular member for resiliently urging the tubular member and fuel control member toward the increased fuel flow direction, and a control lever for applying a preload to the governor spring; and wherein said flyweight arrangement includes a tubular spring carrier slidable on said drive shaft, a finger carried by said carrier disposed for engagement with the other of said ends of said tubular member, and means for controlling the position of the carrier in response to engine speed.

4. The fuel control system of claim 3 wherein said controlling means includes a spring circumscribing the tubular spring carrier, a flyweight carrier driven by said drive shaft, a pair of flyweights pivotally carried by the flyweight carrier and responsive to engine speed for exerting a force to compress the spring, a pair of rollers individually rotatably mounted to the flyweights, and force transmitting means secured to the spring carrier and adapted for engagement with the rollers so that force exerted on the flyweights by the spring when the engine speed drops below said predetermined speed due to a load thereon is transmitted to the spring carrier to move the spring carrier, tubular member and fuel control member in the decreased fuel flow direction.

5. The speed sensitive fuel control system of claim 4 including a collar disposed for engagement with the spring and wherein each of said flyweights has an arm extending therefrom, said arm having a distal end in engagement with said collar.

6. The speed sensitive fuel control system of claim 5 including a first pin pivotally securing each of the flyweights to the flyweight carrier and a second pin rotatably mounting each of the rollers to the flyweights and disposed radially inwardly relative to the first pin, and wherein the second pin is placed closer to the first pin than to the distal end of the arm to provide a mechanical advantage so that the rollers exert a greater force against the transmitting means than that exerted on the arm by the spring.

7. The speed sensitive fuel control system of claim 6 wherein said means for limiting movement of the fuel control member is said controlling means and including a pair of stops secured to the flyweight carrier and a pair of ears extending radially outwardly from said collar for engagement with said stops for limiting the outward pivotal movement of the flyweight when the engine speed exceeds the predetermined speed thereby limiting movement of the spring carrier toward the increased fuel direction.

8. The speed sensitive fuel control system of claim 7 wherein the fuel flow is controlled by rotary motion of the fuel control member and including a lever attached to the fuel control member, a thrust collar slidably disposed on said drive shaft for engagement with the one end of the tubular member, and a bell crank having one arm in engagement with the thrust collar and another arm in engagement with the lever for transforming rectilinear sliding movement of the thrust collar into rotary movement of the fuel control member.

* * * * *